US011059191B2

(12) United States Patent
Spae et al.

(10) Patent No.: US 11,059,191 B2
(45) Date of Patent: Jul. 13, 2021

(54) DUAL KNIFE FOOD CUTTER

(71) Applicants: Johnathan T Spae, Austin, TX (US); Roy Paul Prosise, Cedar Park, TX (US); Daniel F. Caputo, Cedar Park, TX (US); Benjamin D Litteral, Austin, TX (US)

(72) Inventors: Johnathan T Spae, Austin, TX (US); Roy Paul Prosise, Cedar Park, TX (US); Daniel F. Caputo, Cedar Park, TX (US); Benjamin D Litteral, Austin, TX (US)

( * ) Notice: Subject to any disclaimer, the term of this patent is extended or adjusted under 35 U.S.C. 154(b) by 0 days.

(21) Appl. No.: 16/571,679

(22) Filed: Sep. 16, 2019

(65) Prior Publication Data

US 2020/0078967 A1 Mar. 12, 2020

Related U.S. Application Data

(63) Continuation-in-part of application No. 15/256,671, filed on Sep. 5, 2016, now Pat. No. 10,456,941, which is a continuation-in-part of application No. 14/155,313, filed on Jan. 14, 2014, now Pat. No. 9,434,082.

(60) Provisional application No. 61/752,235, filed on Jan. 14, 2013.

(51) Int. Cl.

| | |
|---|---|
| ***B26B 3/04*** | (2006.01) |
| ***B26B 29/02*** | (2006.01) |
| *B26B 5/00* | (2006.01) |

(52) U.S. Cl.
CPC ..... *B26B 3/04* (2013.01); *B26B 29/02* (2013.01); *B26B 5/00* (2013.01)

(58) Field of Classification Search
CPC ..... B26B 29/02; B26B 5/00
See application file for complete search history.

(56) References Cited

U.S. PATENT DOCUMENTS

| | | | | |
|---|---|---|---|---|
| 2,986,815 | A * | 6/1961 | Fernald | B26B 3/04 30/304 |
| 4,299,148 | A * | 11/1981 | Meier | B26D 3/24 30/114 |
| 4,425,706 | A * | 1/1984 | Southworth | B26D 3/24 30/116 |
| D488,682 | S * | 4/2004 | Bertke | D7/693 |
| 9,021,929 | B2 * | 5/2015 | Cordova | A21C 15/04 83/34 |
| 9,352,477 | B1 * | 5/2016 | Warnick | A47G 21/045 |
| 9,545,112 | B1 * | 1/2017 | Strauss | B26D 3/24 |
| 2010/0293790 | A1 * | 11/2010 | Starr | B23D 49/105 30/114 |
| 2012/0304469 | A1 * | 12/2012 | Powell | B26B 29/025 30/143 |
| 2013/0312266 | A1 * | 11/2013 | Steinmann | B26D 3/24 30/114 |
| 2015/0197025 | A1 * | 7/2015 | Spae | B26B 29/00 30/114 |

(Continued)

*Primary Examiner* — Omar Flores Sanchez
(74) *Attorney, Agent, or Firm* — Rick B. Yeager

(57) ABSTRACT

A dual knife food cutter apparatus is configurable into a cutting configuration and a storage configuration. In the cutting configuration, the first blade is attached to the second blade with an internal or external connector to form a substantially contiguous combined cutting side. In the storage configuration, the cutting side of each blade is inserted into a slot of the handle of the other blade.

8 Claims, 37 Drawing Sheets

(56) References Cited

U.S. PATENT DOCUMENTS

| | | | | |
|---|---|---|---|---|
| 2015/0224664 | A1* | 8/2015 | Harkness | B26D 7/2614<br>30/113.3 |
| 2015/0375411 | A1* | 12/2015 | Parr | B26B 29/063<br>83/34 |

* cited by examiner

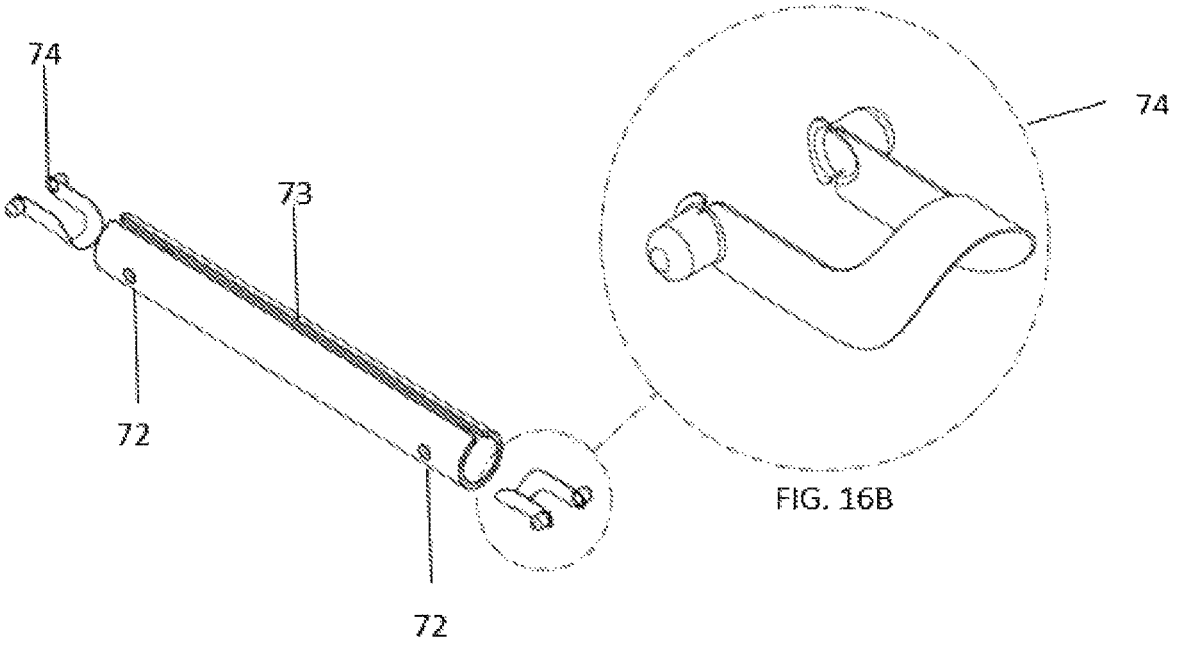
FIG. 16B
FIG. 16A
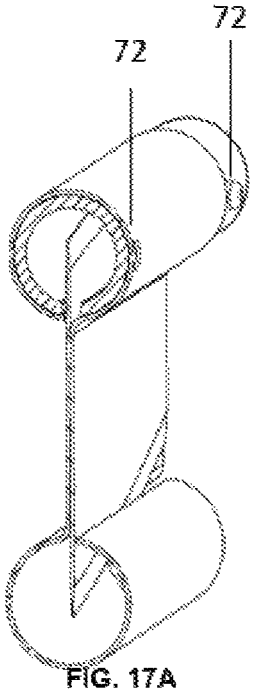
FIG. 17A
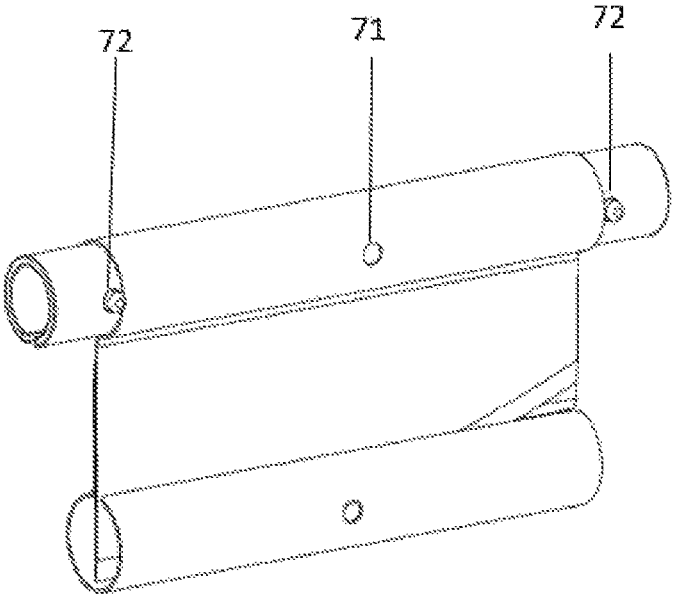
FIG. 17B

DUAL KNIFE FOOD CUTTER

This is a continuation-in-part patent application Ser. No. 15/256,671 filed Sep. 5, 2016 which is a continuation-in-part of U.S. patent application Ser. No. 14/155,313 filed Jan. 14, 2014, which claims the benefit of priority from U.S. Provisional Patent Application Ser. No. 61/752,235 filed on Jan. 14, 2013 and entitled "Dual Knife Food Cutter", which are fully incorporated herein by reference for all purposes.

BACKGROUND

Field of Invention

This invention relates to food cutting devices commonly used in households and commercial applications. More particularly, it relates to food cutting devices used to cut food items like pizza, tortillas, quesadillas, pies, pastries, brownies & baked goods, caramels, as well as mincing herbs & vegetables.

Prior Art

Rocker food cutting devices are well known. In such rocker food cutting devices, the blade of the knife is curved convexly to provide a cut with a simple rocking motion of the knife. Exemplary of the prior art is:

Santana U.S. Pat. No. 1,414,098 describes a cigar-maker's knife with a convex blade and a rolled integral handle.

Watermolen et al U.S. Pat. No. 5,920,992 describes a pizza cutter with a convex blade with two handles providing finger indentations.

Ghislain U.S. Pat. No. 4,959,905 describes a pizza cutting device with a convexly curved blade with a handle extending the length of the blade. The food cutting device can be stored in a separate holder that receives the blade when not in use.

James U.S. Pat. No. 4,924,575 describes a pizza knife with convex blade with an integral handle that extends the length of the blade.

Cremonese U.S. Pat. No. 3,890,707 describes a kitchen knife with a straight edge in the back with an attached handle spanning a portion of the blade with an aperture below for fingers to wrap around. The blade being curved from the straight edge in the back to the point in the front.

All of the aforementioned food cutting devices are cumbersome to store when not in use. A common place to store a food cutting device like this would be a drawer, but the prior art devices are large and have exposed blades, and in the case of U.S. Pat. No. 4,959,905, requires storage outside of a drawer because of the large holder of the blade. The present invention overcomes this storage issue by breaking down into two separate knives that are stored with each knife's blade being stored in the handle of the other. The storage position of the present invention is therefore smaller and easier to store in a drawer along with other kitchen tools, and safer because the knife blades are stored securely in the handles.

SUMMARY OF THE INVENTION

Embodiments of a dual knife cutting device overcome two problems associated with existing food cutters, more specifically, the size issue and safety issue of storing the food cutting device. The storage configuration of the present invention is half the size of the full food cutter making the food cutter easier to store with other kitchen tools. The present invention is also safer than current food cutting devices because the blades of the knives are safely stored inside the handles when in storage position. The present invention also has the added benefit of being two individual knives. These individual knives can function as cleavers, choppers, mincers, scrapers, etc. for many different kinds of food items.

BRIEF DESCRIPTION OF THE DRAWINGS

In the accompanying drawings which form a part of the specifications and are to be read in conjunction therewith and in which like reference numerals are used to indicate like parts in the various views:

FIG. 16A. Is an isometric view of the internal connector component and a zoom perspective on the u-shaped spring-clip of the dual knife food cutter of FIG. 14.

FIG. 16B. Is a detailed view of the internal connector component of FIG. 16A.

FIG. 17A. Is an end view of the dual knife food cutter of FIG. 14 in a storage position.

FIG. 17B. Is a front isometric view of the dual knife food cutter in FIG. 17A accenting the connector piece equally spaced and held in place by the spring clip buttons in the storage position.

DEFINITIONS

Figure 1:
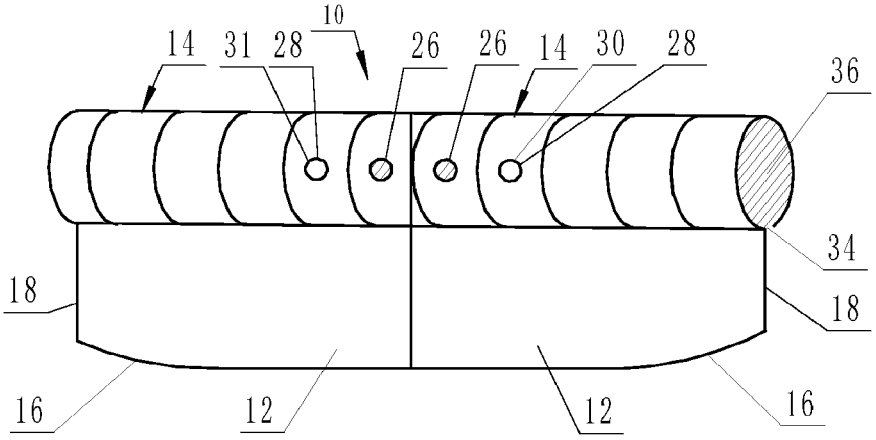
FIG. 1. Is a perspective view of a dual knife food cutter constructed according to an embodiment of the invention.

In this specification, the terms "dual knife food cutter apparatus" or "dual knife device" refers to a cutting utensil which has a first blade and a second blade that may be assembled to work as a single cutting utensil.

In this specification, the term "blade" refers to a generally planar cutting element. There are two based in a "dual knife device". In some configurations, the blades may be assembled to work together as a single cutting unit; and in other configurations, a single blade may be used.

In this specification, the term "front side" refers to an elongated planar surface of a blade; and the term "rear side" refers to the opposite planar surface of the blade.

In this specification, the term "inside edge" refers to an edge of the elongated planar front surface of a blade which is proximal to a second blade when the dual knife device is configured to function as a single cutting utensil; and the term "outside edge" refers to the opposite edge of a blade which is distal to the other blade when the dual knife device is configured to function as a single cutting utensil.

In this specification, the terms "cutting side" or "cutting edge" refers to a bottom edge along a blade; and the terms "handle side", "handle edge", or "handle portion" refer to the top edge of a blade which typically has an enlarged cross section which is configured to mate with the top edge of the other blade or with an external or internal connector in order to combine the blades. The cutting edge may be sharpened in knife embodiments, or blunt for uses such as in processing dough. The cutting edge can be straight but need not be, and need not be parallel to the handle edge. In some examples, the cutting edge of each blade is curved so that the inside edge is longer than the outside edge, and the assembled device may be rocked along the cutting edges of the blades.

In this specification, the terms "connector" or "connecting element" refers to a separate element or blade handle extension which permits two blades to be removably combined to a single unit. In various examples, the connector may utilize spring clips, integral spring buttons, threads, snap-fit, or press-fit features.

In this specification, the term "handle mating feature" refers to a spring button hole, press fit, snap feature, or other feature which permits a blade handle to be secured to a connector or connecting element. For instance, in spring button embodiments, the handle mating feature is typically a hole or a pair of holes in the handle to accept a spring button.

In this specification, the term "connector feature" refers to a spring clip, integral spring button or other element which removably secures a portion of a connector to a handle blade.

In this specification, the term "internal connector" means an element where at least a portion of the element fits inside of at least a portion of a handle.

In this specification, the term "external connector" means an element where at least a portion of the element fits over at least a portion of a handle.

In this specification, the terms "blade connection element" means a feature provided on the inside edge of at least one blade which mates with a portion of the other blade at a position between the blade handle portion and the blade cutting edge. One or more blade connection element maybe used to provide a connection between the inside edges of the blades in order to provide or strengthen the connection between blades.

Referring now to the drawings in more detail, in FIG. 1 numeral 10 generally designates a dual knife food cutter apparatus configurable into a cutting configuration and a storage configuration. In this embodiment, the handle side 14 of the first blade and second blade is formed integrally from the same material as the cutting side 16. The blade 12 and the integral handle 14 are formed as a single stainless steel piece in this embodiment, but in other embodiments the apparatus is comprised of food grade material in a group consisting of food grade metal, plastic, silicone, rubber, carbon fiber, ceramic, wood, or a combination thereof.

Figure 5:
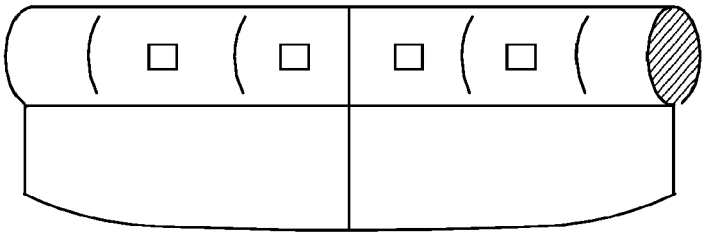
FIG. 5. Is a perspective view of a dual knife food cutter with the handle side of the first blade and second blade fixedly attached to the cutting side and not formed integrally out of the same material.
Figure 9:
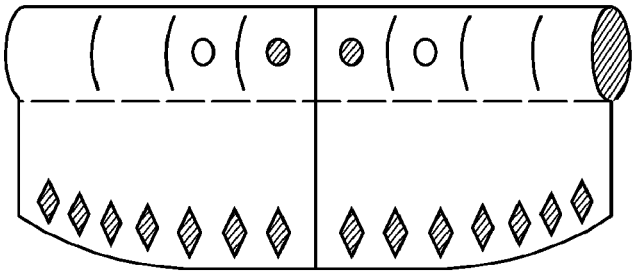
FIG. 9. Is a perspective view of a dual knife food cutter with a Granton edge on the cutting side.
Figure 10:
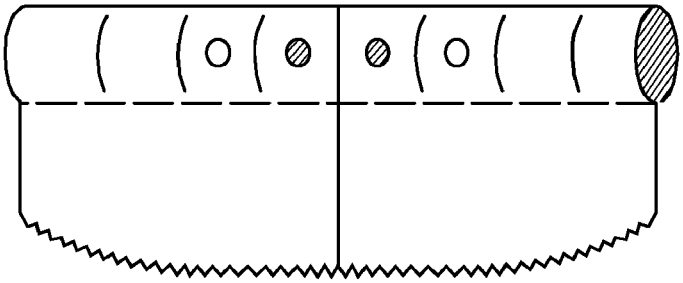
FIG. 10. Is a perspective view of a dual knife food cutter with a serrated edge on the cutting side.

Also, in other embodiments the handle side of the first blade and second blade is fixedly attached to the cutting side and not formed integrally out of the same material as referenced in FIG. 5. The cutting side 16 of the first blade and the cutting side 16 of the second blade have a sharpened edge in this embodiment. In this example, the cutting side 16 of the first blade and the cutting side 16 of the second blade also have a convex edge to provide a cut with a simple rocking motion of the knife in this embodiment. In another embodiment referenced in FIG. 9, the cutting side of the first blade or second blade, or both blades, further comprises a Granton edge. Or in another embodiment referenced by FIG. 10, the cutting side of the first blade or second blade, or both blades, further comprises a serrated edge. Although the dimensions can vary, the total combined blade length of the dual knife food cutter should be long enough to cut conventionally sized pizzas, which would be in the range of 12 inches up to 24 inches. In this embodiment, the blade length and full food cutter length is 13 and ¾ inches. The full food cutter in this embodiment is 3 and ¾ inches in width from the top of the handle to the bottom of the middle of the dual knife food cutter. The width could range from 2 inches to 8 inches in other embodiments. The full food cutter in this embodiment is 2 and ½ inches in width from the top of the handle to the bottom of the front side 18. This could range from 1 inch to 7 inches in other embodiments.

The cutting side 16 of the first knife and second knife has a sharpened edge in this embodiment and the cutting side 16 extends along substantially the entirety of the bottom portion of the blade 12. However, on opposite end 18 of the blade 12, which is a front side adjacent to the cutting side, it is preferred that the blade edge not be sharpened in this embodiment in order to avoid possible inadvertent cutting of the hands when the food cutter is used.

Figure 3A:
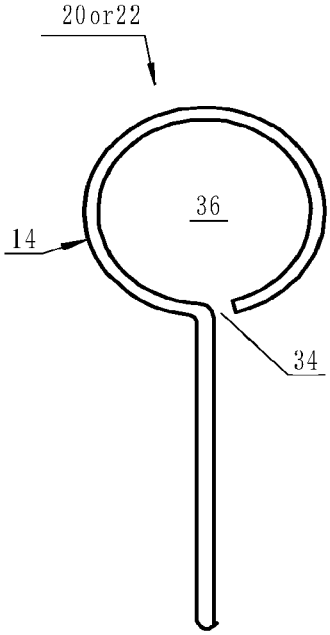
FIG. 3A. Is an end view of one of the individual knives with integral handle according to an embodiment of the invention.
Figure 4A:
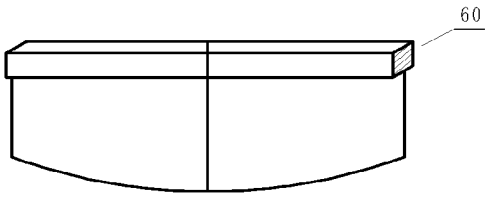
FIG. 4A. Is a perspective view of a food cutter with a square handle side according to an embodiment of the invention.
Figure 4B:
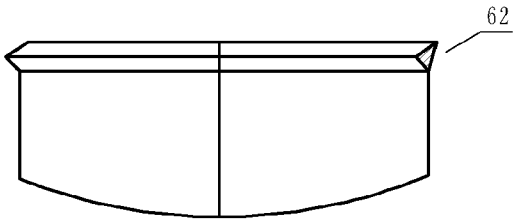
FIG. 4B. Is a perspective view of a food cutter with a triangle handle side according to an embodiment of the invention.

In this embodiment there is a handle side 14 opposite to the cutting side and substantially parallel to the cutting side comprising a hollow channel fixedly attached to the blade further comprising a slot in the channel wherein the slot is sized to allow insertion of the cutting side of a second blade. In this embodiment the handle side of the first blade and second blade and the connector are cylindrical shaped tubes. The hollow channel 36 extends the length of the blade. The interior diameter of the hollow channel 36 is 1 inch in size in this embodiment but could range from ¼ inch to 4 inches in other embodiments of the invention. In other embodiments, the handle side of the first blade and the connector comprise a polygon shaped cross section. In other embodiments the handle side and connector are square, triangle, or another shape as referenced in FIG. 4. As referenced in FIG. 3A, the handle side 14 is formed so the blade extends down from the middle of the handle side in this embodiment. The hollow channel of the handle side has a slot 34 which extends the length of the handle side 14 which has a width of approximately ⅛ inch in this embodiment, and could range in size from 1/16 inch to 1 inch in other embodiments.

Figure 2:
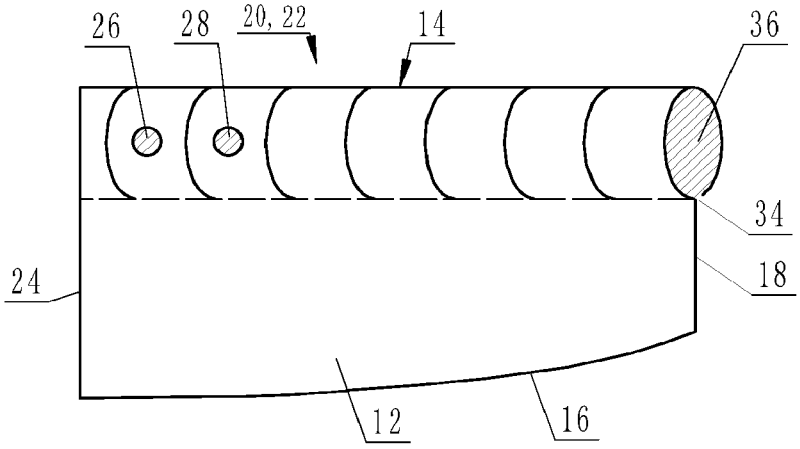
FIG. 2. Is a front elevation view of one of the two knives that can be used separately and to form the complete dual knife food cutter in an embodiment of the invention.

Referring to FIG. 2, knife 20 or 22 is a first blade made of rigid material. In this embodiment the full food cutter is divided down the middle to provide two knives of equal size. In another embodiment the individual knives are manufactured separately. It should be made clear that regardless if the two knives are manufactured separately or as one full food cutter, the two knives 20 & 22 can be used interchangeably in this embodiment of the invention. The second blade is substantially identical to the first blade. In this embodiment the individual knives are 6 & ⅞ inches each in length but the lengths could range from 6 inches to 12 inches in other embodiments. The widths of the knives are the same as the full food cutter, 3 and ¾ inches from the top of the handle down the end of a back side 24 opposite of the front side 18 substantially perpendicular to the cutting side, and 2 and ½ inches from the top of the handle down to the end of front side 18. These widths could range from 1 to 8 inches in other embodiments. With the back side 24 of the blade 12, as front side 18, it is preferred in this embodiment that these sides not be sharpened in order to avoid possible inadvertent cutting of the hands when the knife is used. Two holes 26 & 28 are drilled through handle side 14 and are located in the same position on each side of the handle. The holes in this embodiment are ¼ inch but could be 1/16 to 1 inch in other embodiments. Holes 26 & 28 referenced in FIG. 2 serve to lock in the spring clips 30 & 31 of the connector 32 referenced in FIG. 3B and FIG. 3C. The spring buttons that lock into the holes in this embodiment are ¼ inch but could be 1/16 to 1 inch in other embodiments. In this embodiment there is a connector sized for insertion into the hollow channel of the handle side of the first blade and the hollow channel of the handle side of the second blade. Also in this embodiment the handle side of the first blade further comprises holes and the connector further comprises spring buttons wherein the holes and spring clip buttons are aligned to secure the connector into the handle side of the first blade when in the cutting configuration. The spring buttons can be integral to the connector as shown in FIGS. 40A-D or as separate spring clip buttons as shown in FIGS. 16A-B, and FIGS. 3B-C.

Figure 3B:
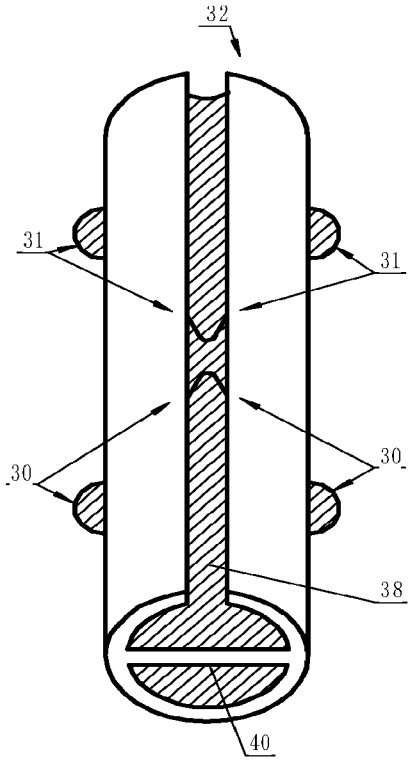
FIG. 3B. Is a perspective view of the connector with spring clips located inside the connector that are locked in holes of the connector in an embodiment of the invention.
Figure 3C:
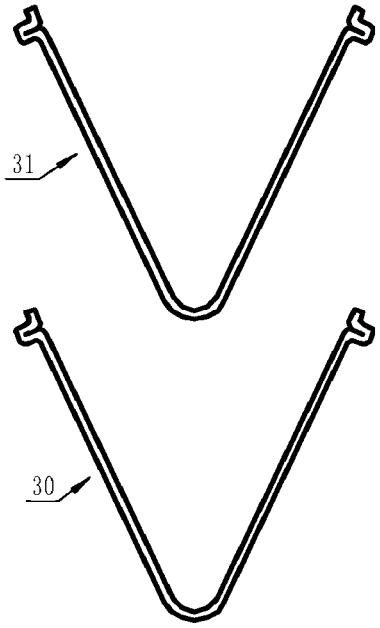
FIG. 3C. Is a front elevation view of the two spring clips used in an embodiment of the invention.
Figure 13A:
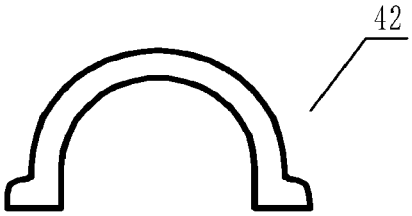
FIG. 13A. Is a front elevation view of a spring clip with a semi-circle shape.
Figure 13B:
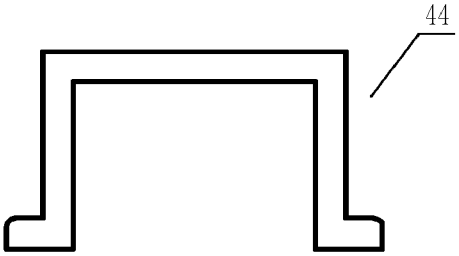
FIG. 13B. Is a front elevation view of a spring clip with a square shape.

Referencing FIG. 3B and FIG. 3C, spring clips 30 & 31 are inserted in connector 32. Spring clips 30 & 31 have tension when squeezed that provide an adequate locking mechanism to the holes inside the connector 32 and then in the holes of the handle sides of the knives. The spring clips will automatically lock into place when a hole is found because of this inherent tension while squeezed. The leg length for the spring clips used in this embodiment are 1 and ½ inches but the size of the clips could range from ½ inch to 4 inches in other embodiments. In another embodiment, spring clips that are a semi-circle shape 42 as referenced in FIG. 13A are used and fit into the connector while hugging the side of that connector. FIG. 16A and FIG. 16B also demonstrate a semi-circle or u shaped spring clip embodiment. A square shaped spring clip 44 referenced in FIG. 13B is used to hug the side of a square shaped connector in another embodiment. Spring clips 30 & 31 and connector 32 referenced in FIG. 3B and FIG. 3C are made in this embodiment from stainless steel but in other embodiments the spring clips and connector can be comprised of other food grade materials. The spring buttons can also be made integral to the connector in other embodiments as referenced in FIGS. 40A-D. The connector and integral spring buttons 76 are made out of a food grade resin material in this embodiment, but in other embodiments the connector and integral spring buttons can be made of other food grade materials. The spring buttons and connector can also be made of the same material or different material in other embodiments. The connector 32 is of the exterior diameter size to be a tight fit within the interior diameter of the hollow channel 36 referenced in FIG. 3A. The connector has an exterior diameter slightly smaller than 1 inch in this embodiment but could be ¼ inch to 4 inches in other embodiments. The length of the connector 32 is 5 inches in this embodiment but could be 3 inches to 15 inches depending on the length of the full food cutter in other embodiments. Connector 32 has a slot 38 which has a width of approximately ⅛ inch in this embodiment.

Figure 13C:
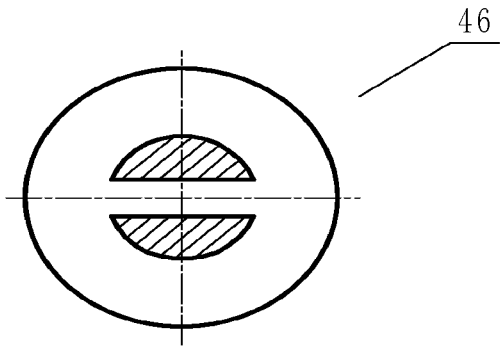
FIG. 13C. Is a front elevation view of a side cap for the connector that can be used to pull the connector from the handle side of the knife in storage position.
Figure 13D:
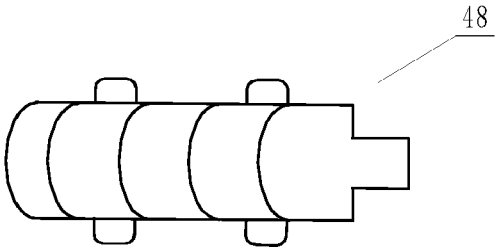
FIG. 13D. Is a perspective view of the connector with a tab extending out of the connector and past the handle side of the knife in storage position.

In other embodiments this slot could range in size from 1/16 inch to 1 inch. In this embodiment the connector stays exposed outside of the hollow channel of the knife handle when in storage position in order to pull the connector out from the handle. 1 inch of the connector is outside of the hollow channel in this embodiment as referenced in FIG. 8. In other embodiments ¼ inch to 4 inches of the connector remains exposed in order to pull the connector from the handle. In another embodiment referenced in FIG. 3B, connector 32 has a bar 40 at the side end in which to grab and pull out the connector when in storage position. In other embodiments there is a cap 46 at the side end with a bar located inside the cap 46 referenced in FIG. 13C or a tab 48 at the side end of the connector 32 referenced in FIG. 13D.

Figure 6:
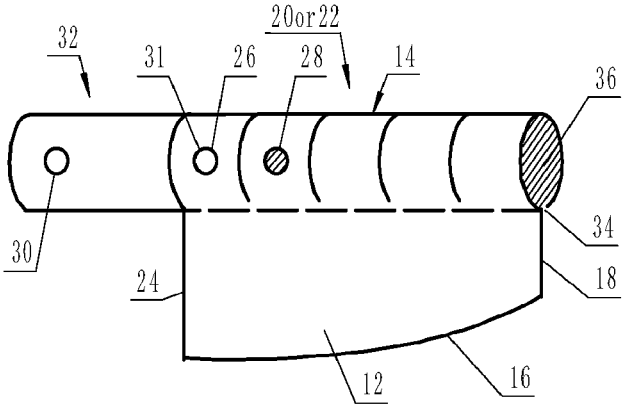
FIG. 6. Is a perspective view of one of the two knives with the connector attached which can be used as a handle extension for the individual knife and to connect the two knives to form the complete dual knife food cutter.

Referencing FIG. 6, connector 32 is inserted into knife 20 or 22. It should be made clear that this arrangement is the same when using either knife 20 or 22. Spring clip 31 of the connector tube is locked into place in hole 26 of the handle side of the knife. This arrangement is considered the butcher knife configuration of this embodiment of the invention. The connector is used as a handle extension for the handle side of the individual first or second knife. In other embodiments the other spring clip 30 or the other hole 28, or other combinations of the spring clips and holes can be used for this handle extension. In other embodiments spring buttons can be made integral to the connector as referenced in FIGS. 40A-D. and utilized to lock in a hole of the blade handle.

Figure 7:
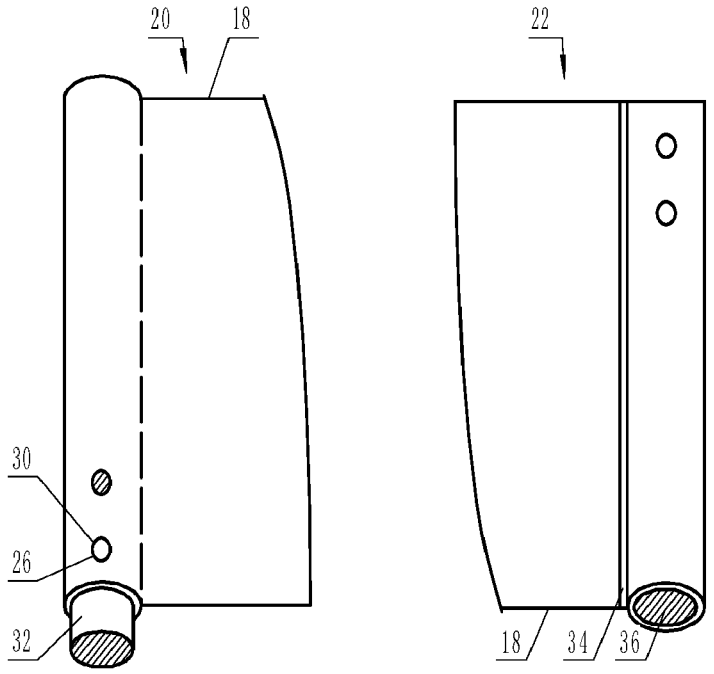
FIG. 7. Is a front elevation view of the two knives facing opposite sides being in the position for storage in an embodiment of the invention.

Referencing FIG. 7, knife 20 and knife 22 are positioned to be opposite of one another. It should be made clear again that the two knives can be used interchangeably in this embodiment. Knife 20 is placed with the front side 18 up and knife 22 with the front side 18 down. Knife 22 has the slot 34 exposed within view, while knife 20 does not in this scenario. Knife 20 has the connector 32 inserted into the hollow channel 36. The slot 38 of the connector referenced in FIG. 3B will line up with the slot 34 of the knife. Spring clip 30 locks into place with hole 26 in this configuration. In other embodiments spring buttons can be made integral to the connector as referenced in FIGS. 40A-D. and utilized to lock in a hole of the blade handle.

Figure 8:
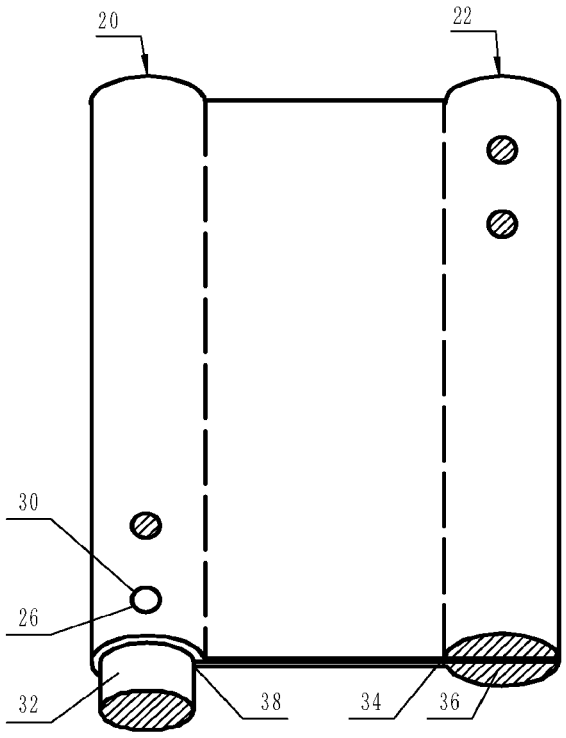
FIG. 8. Is a front elevation view of the final storage position in an embodiment of the invention. The cutting side of each blade is stored within the handle side of the other blade. The connector extends out past the end of the handle side of the knife in order to grab and pull out the connector from the handle side in an embodiment of the invention.

Referencing FIG. 8, wherein in the storage configuration, the cutting side of the first blade is inserted into the slot of the handle side of the second blade and the cutting side of the second blade is inserted into the slot of the handle side of the first blade. The cutting sides have a secure fit inside slot 34. The connector 32 is also inserted into the hollow channel 36. The cutting sides of the blades fit within the connector slot 38.

Returning to FIG. 1, wherein in the cutting configuration, the first blade is attached to the second blade such that the back side of the first blade abuts the back side of the second blade, the cutting side of the first blade and the cutting side of the second blade form a substantially contiguous combined cutting side. In this embodiment, connector 32 is inserted into one knife with spring clip 31 locking into hole 28. Knives 20 & 22 are brought together with back side 24, referenced in FIG. 2, of each knife facing the other. Connector 32 is inserted into the other knife and spring clip 30 is locked into hole 28 of the other knife. In other embodiments spring buttons can be made integral to the connector as referenced in FIGS. 40A-D. The integral spring buttons 76 are utilized to lock in a hole of the blade handle.

The connector attaches the knives so the back sides abut each other and the cutting side of the first blade and the cutting side of the second blade form a contiguous cutting side. This arrangement is considered the full food cutter configuration in this embodiment of the invention.

Figure 11:
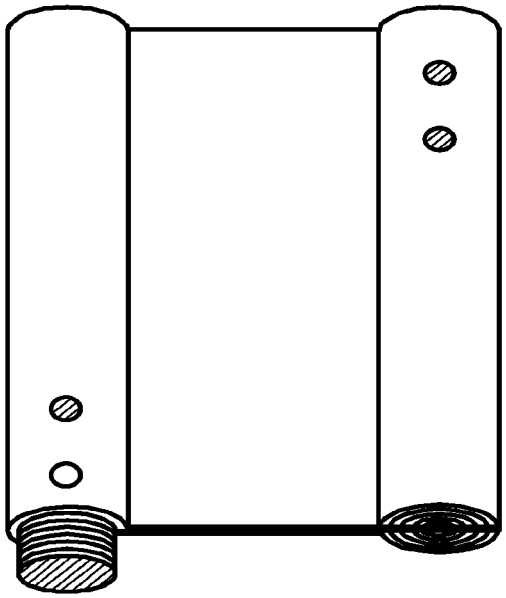
FIG. 11. Is a front elevation view of a screw type connection for the dual knife food cutter wherein one blade has a male member protruding from the handle side with threading on the exterior and the other blade has a female connection in the handle side with threading on the interior according to an embodiment of the invention.

Other embodiments include the first blade and second blade being attached with a screw type connection wherein one blade has a male member protruding from the handle side with threading on the exterior and the other blade has a female connection in the handle side with threading on the interior as referenced in FIG. 11. Referencing FIG. 13E, numeral 50, is another embodiment wherein the first blade and second blade are attached with a male connector that attaches to female holes or rivets in the handle side of the first blade and second blade. Referencing FIG. 13F, numeral 52, is another embodiment wherein the first blade and second blade are attached with a male connector that attaches to female holes or rivets in the blades of the first knife and second knife. In this example, the male connector serves as a blade connection element which acts to keep the blades coplanar. Referencing FIG. 13G, numeral 54, is another embodiment wherein the first blade and second blade are attached with a male fitting on the end of the handle side of one blade connecting to a female gap on the end of the handle side of the other blade. Referencing FIG. 13H, numeral 56, is another embodiment wherein the first blade and second blade are attached with a male fitting on the end of the back side of one blade connecting to a female gap on the end of the back side of the other blade. In this example, the male and female features serve as a blade connection element which acts to keep the blades coplanar. Referencing FIG. 13I, numeral 58, is another embodiment wherein the first blade and second blade are attached with a connector that swivels out from the blade of one knife and connects to a hole or notch in the blade of the other knife. Referencing FIG. 12A, numeral 64, is another embodiment wherein the first blade and second blade are attached with a bayonet type connection where outwardly projecting L shaped grooves from a slightly extended handle side of the male blade attaches with the female blade handle side which has at least two inwardly projecting grooves sized and shaped to engage the L-shaped grooves of the male blade. In this example, the bayonet type connection serves as a blade connection element which acts to keep the blades coplanar. Or another embodiment referencing FIG. 12B, numeral 66, wherein the first blade and second blade are attached with a bayonet type connection where button type fittings on the male blade attach to L-shaped grooves on the female blade and twist to lock into place.

DETAILED DESCRIPTION

Removable Internal Connector

Figure 15:
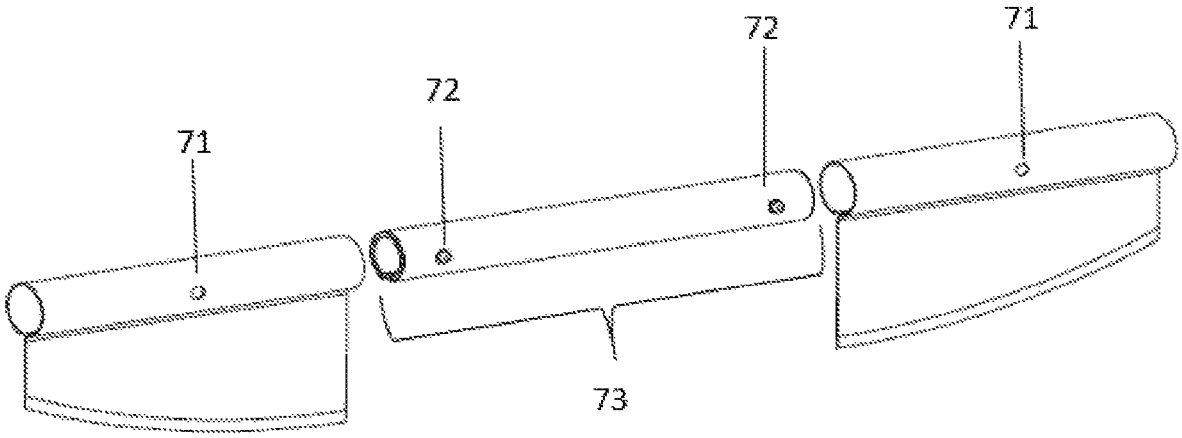
FIG. 15. Is an exploded view of the two blades and internal connector component of the dual knife food cutter of FIG. 14.
Figure 18A:
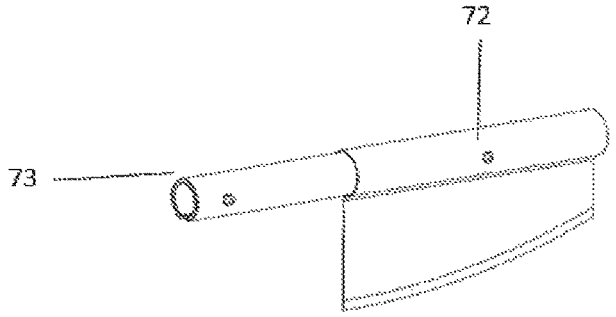
FIG. 18A. Is an isometric view of the dual knife food cutter of FIG. 14 in a knife/meat cleaver position for one side of the food cutting blade with internal connector/handle.
Figure 18B:
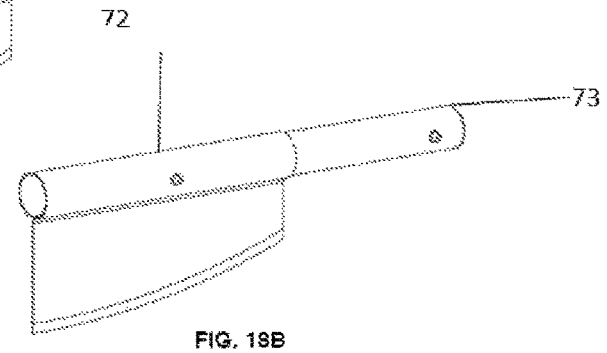
FIG. 18B. Is an isometric view of the dual knife food cutter of FIG. 14 in a knife/meat cleaver position for the other side of the food cutting blade with internal connector/handle.

FIGS. 14-18 illustrate an embodiment example of a dual knife food cutter with a single snap feature on both knives that utilize a long internal connector and u-shaped spring clips (enlarged element 74 shown in FIG. 16) to adjust the various cutting and storage modes. In FIG. 15, the holes on the blade handles labeled element 71 are positioned in the middle of the blade handles so that if one blade is disengaged the dual knife food cutter becomes a cleaver as shown in FIGS. 18A-B. In this embodiment, the internal connector 73, can be disengaged for storage mode so that the internal connector has even overhang on each side of the blade handle shown in FIGS. 17A-B. FIG. 17B shows this example in storage mode where the spring button elements 72 can hold the internal connector securely within the knife handle. This embodiment example is shown with the blade and handle integrally rolled from the same material, however the blade and handle may be separate components as shown in other embodiment examples. In other embodiments spring buttons can be made integral to the connector as referenced in FIGS. 40A-D. The integral spring buttons 76 are utilized to lock in a hole of the blade handle.

Removable External Connector

Figure 19:
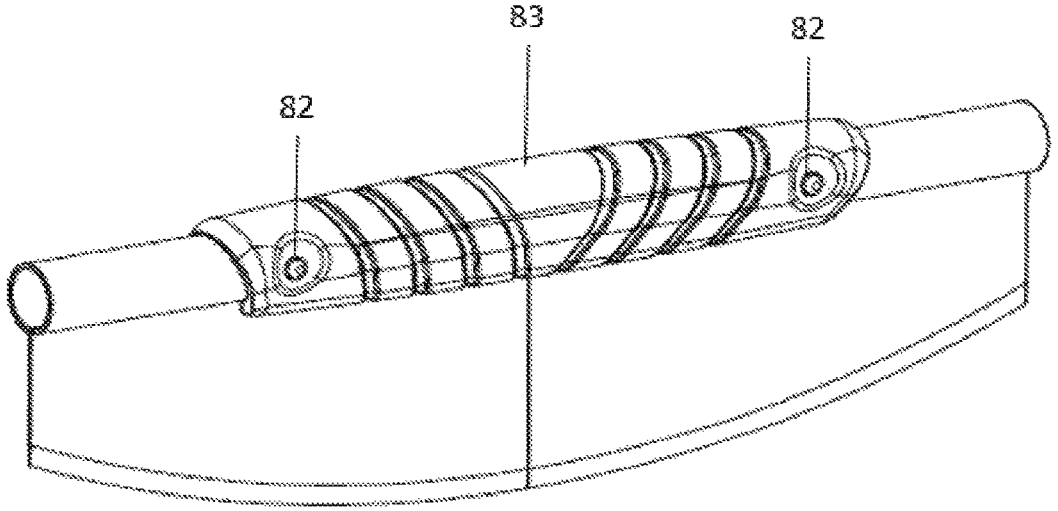
FIG. 19. Is a front isometric view of the first embodiment example of a dual knife food cutter with an external connector/handle component in cutting mode.
Figure 20A:
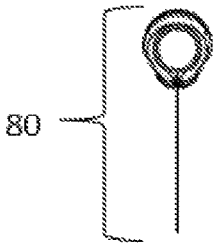
FIG. 20A. Is an end view of the dual knife food cutter in cutting mode shown in FIG. 19.
Figure 20B:
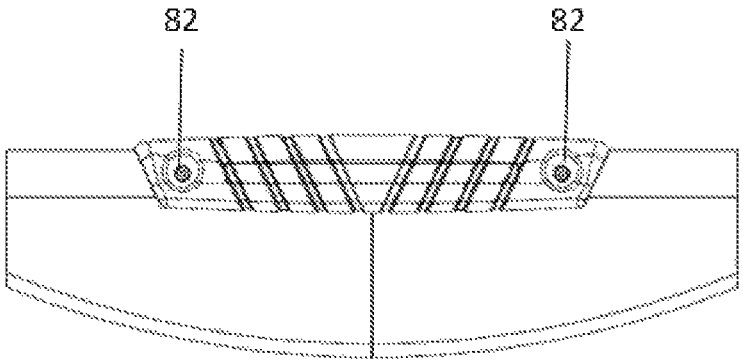
FIG. 20B. Is a front view of the dual knife food cutter in cutting mode of the embodiment shown in FIG. 20A.
Figure 20C:
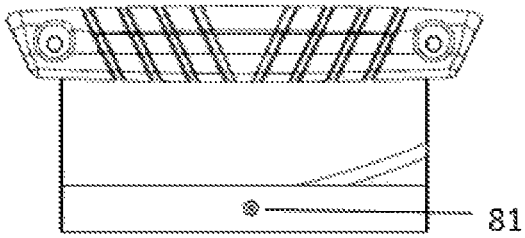
FIG. 20C. Is a front view of the dual knife food cutter in storage mode of the embodiment shown in FIG. 20B.
Figure 21:
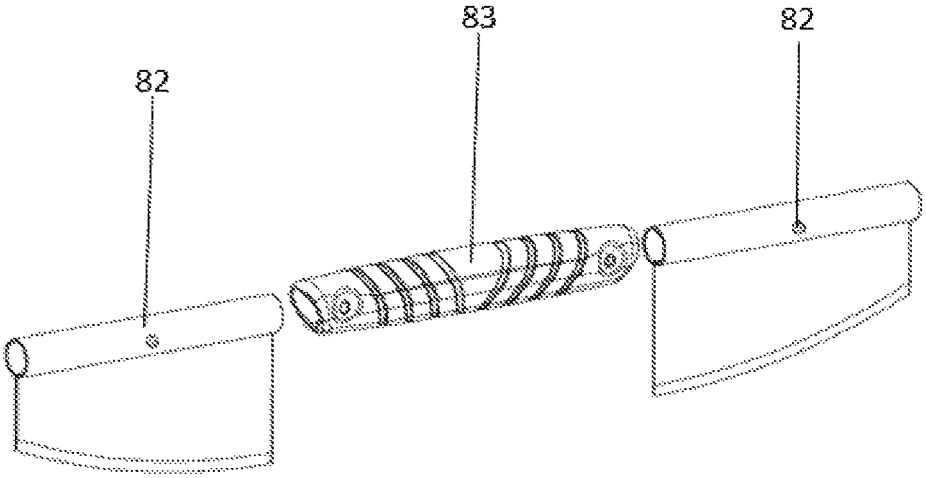
FIG. 21. Is an exploded view of the two blades and external connector component of the dual knife food cutter of FIG. 19.
Figure 22A:
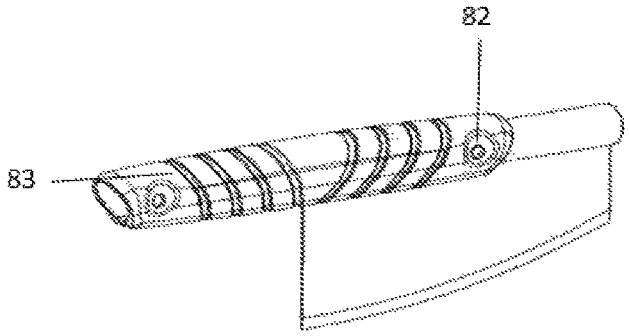
FIG. 22A. Is an isometric view of the dual knife food cutter of FIG. 19 in the knife/meat cleaver position for one side of the food cutting blade with external connector/handle.
Figure 22B:
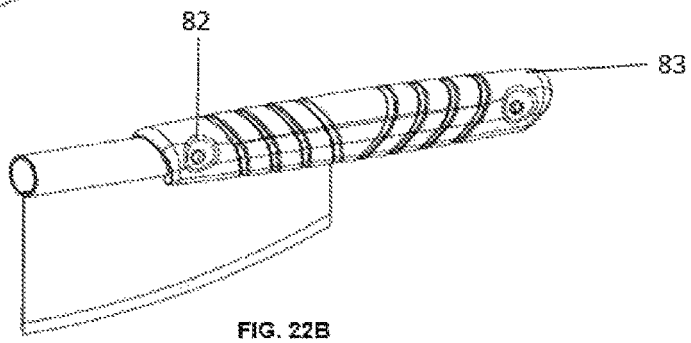
FIG. 22B. Is an isometric view of the dual knife food cutter of FIG. 19 in the knife/meat cleaver position for the other side of the food cutting blade with external connector/handle.
Figure 23:
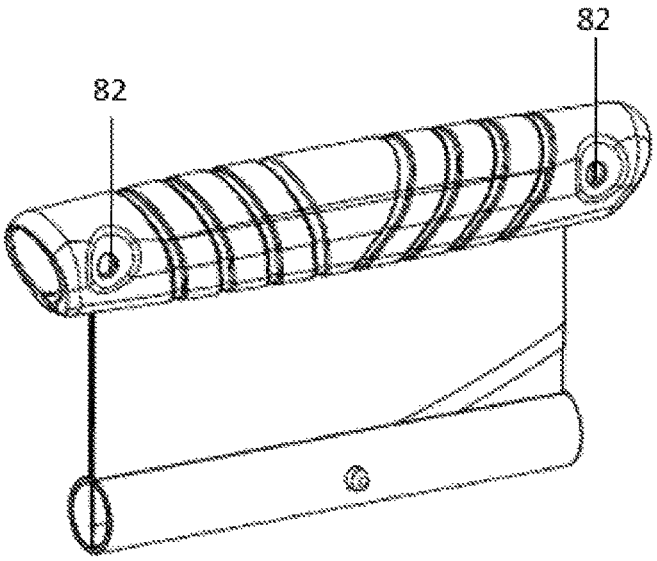
FIG. 23. Is an isometric view of the dual knife food cutter of FIG. 19 in storage mode.
Figure 24A:
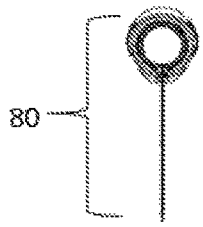
FIG. 24A. Is an end view of a second embodiment example of the external connector, dual knife food cutter in cutting mode.
Figure 24B:
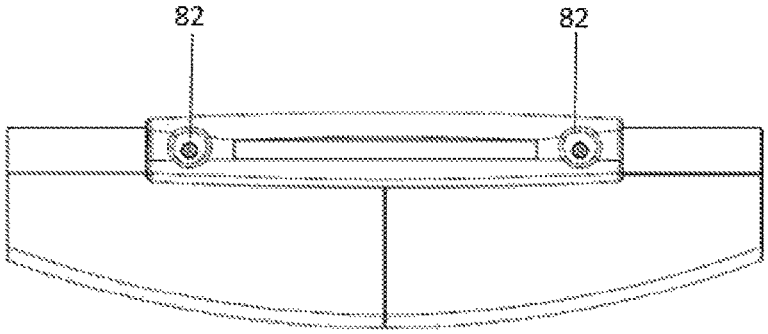
FIG. 24B. Is a front view of the dual knife and food cutter in cutting mode of the embodiment shown in FIG. 24A.
Figure 24C:
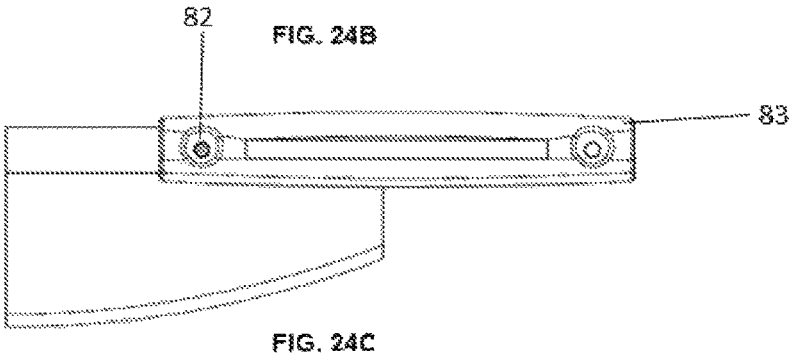
FIG. 24C. Is a front view of the dual knife food cutter in knife/cleaver mode of the embodiment shown in FIG. 24B.
Figure 25:
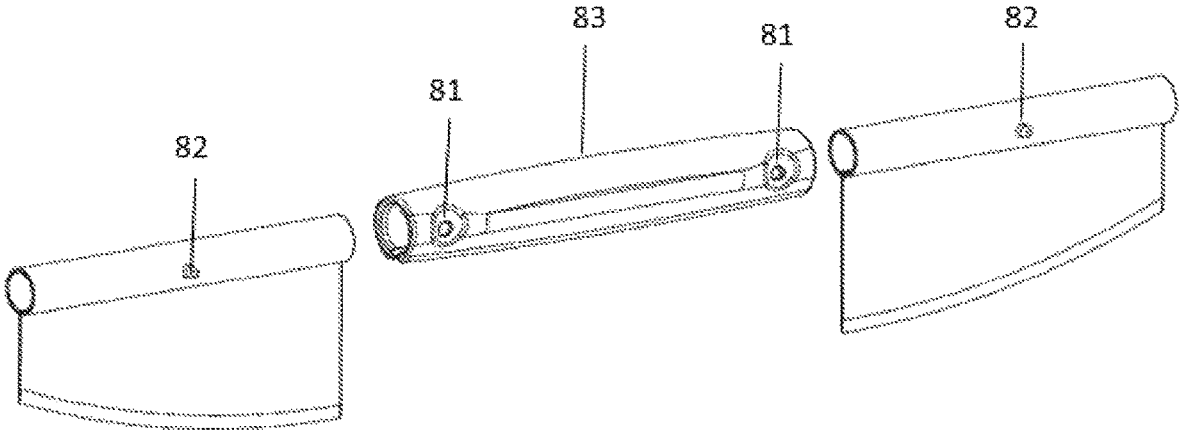
FIG. 25. Is an exploded view of the two blades and external connector component of the dual knife food cutter of FIGS. 24A-C.
Figure 26:
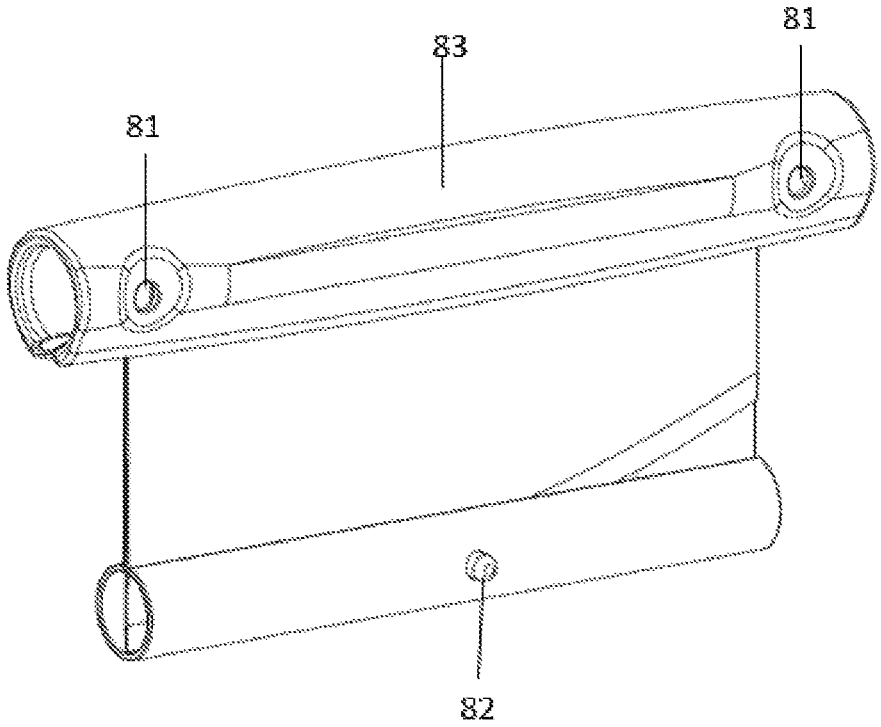
FIG. 26. Is an isometric view of the dual knife food cutter of FIG. 25 in storage mode.
Figure 27:
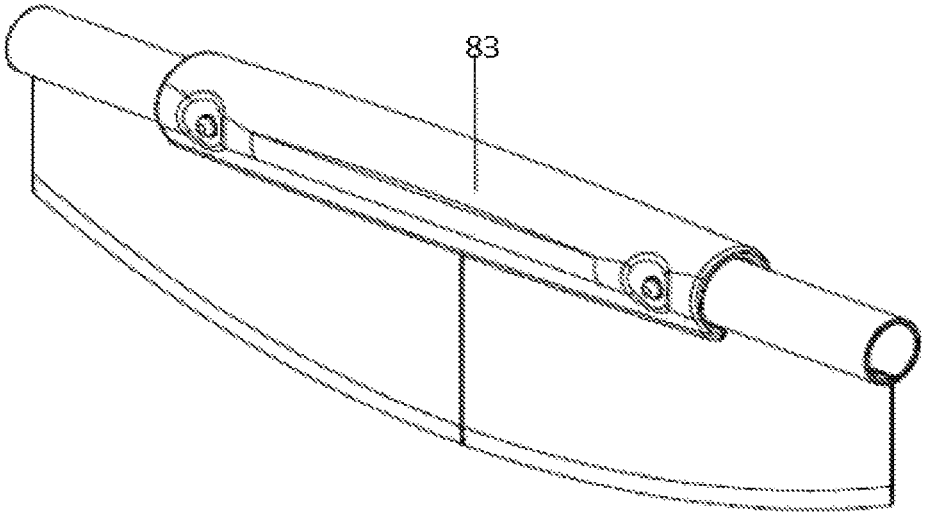
FIG. 27. Is an isometric perspective of the dual knife food cutter of FIG. 26 in cutting mode.

FIGS. 19-27 show two embodiment examples of a dual knife food cutter that uses an external blade connector 83 in FIG. 19. FIGS. 19-23 show a handle design with grooves for ergonomic or branding purposes in comparison to the plain surface design of FIGS. 24-27. In both embodiment examples shown in the aforementioned figures, the locking elements 81 are
located inside the blade handle tube. In other embodiments, the locking elements can be alternative mating configurations that lock the external connector and blade handles into place. Also the two embodiment examples of FIGS. 19-27 may be configured with a portion of the external connector extending beyond the blade tube illustrated in FIG. 22A, 22B, and FIG. 24C so that a blade may be used as a cleaver or chopper knife. FIG. 23 & FIG. 26 show this embodiment in the storage configuration.

Foldable External Connector

In another embodiment an external connector option is constructed in three parts so that the blades can collapse and fold together for storage mode. The external connector fits over the handle portion of the blades while a hinge like feature allows the blades to collapse into storage mode. The external connector can snap together in order to keep the apparatus together in storage mode. The external connector will snap over the top edge of the knife to allow the blade handle to slide for various cutting modes.

Other Blade Features

Figure 28:
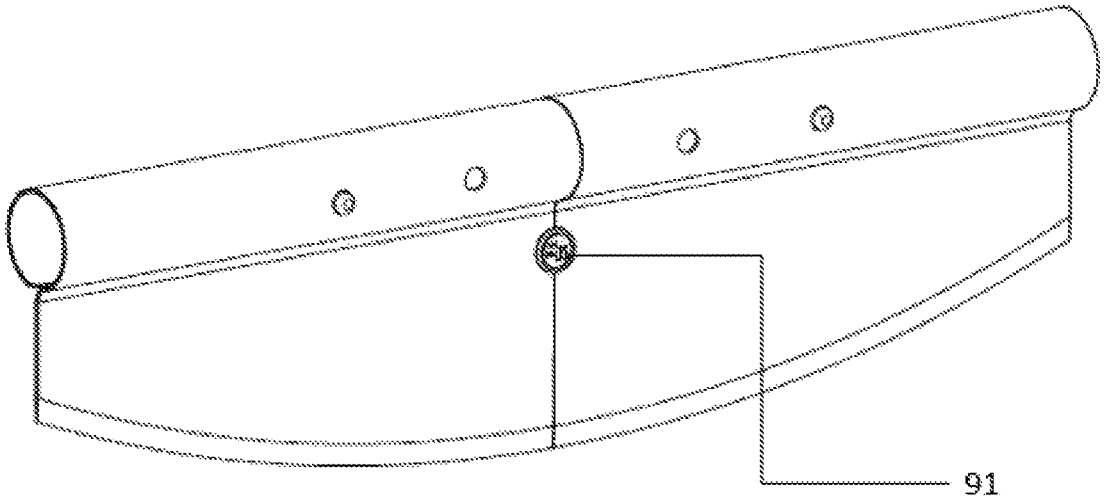
FIG. 28. Is an isometric perspective of another blade connection element to maintain a coplanar orientation of the blades.
Figure 29:
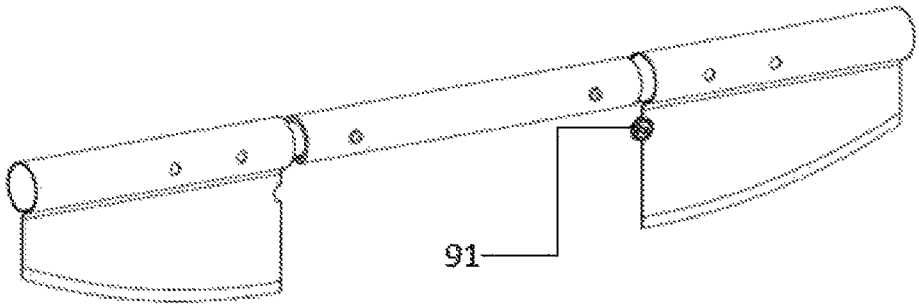
FIG. 29. Is an exploded view of the embodiment in FIG. 28.
Figure 30A:
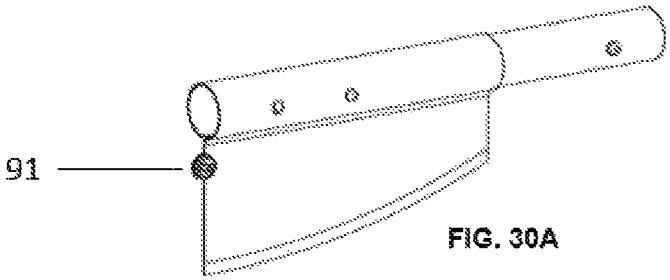
FIG. 30A. Is an isometric view of the dual knife food cutter of FIG. 29 in a first knife/cleaver orientation with the blade connection element of FIG. 28.
Figure 30B:
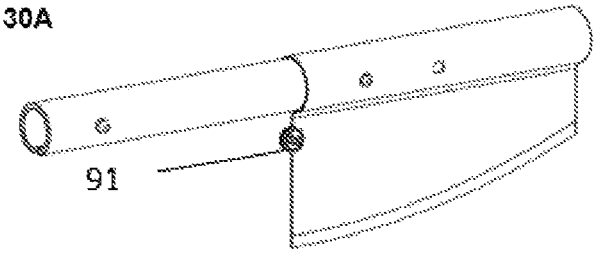
FIG. 30B. Is an isometric view of the dual knife food cutter of FIG. 29 in a second knife/cleaver orientation with the blade connection element of FIG. 28.
Figure 31:
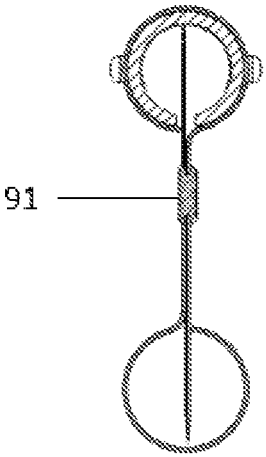
FIG. 31. Is an end view of the dual knife food cutter of FIG. 29.

FIGS. 28-31 demonstrate an embodiment example of a blade interlocking method to reduce flex between the blades when using the dual knife food cutter. Element 91 in FIG. 28 is a circular tab example of a blade connection element. In this example, a portion of the tab receives the other blade half within a tab groove. The blade interlocking method can be various shapes and designs on the blades or blade handles as shown, but not limited to, the other examples shown in FIGS. 13E-I.

Figure 32:
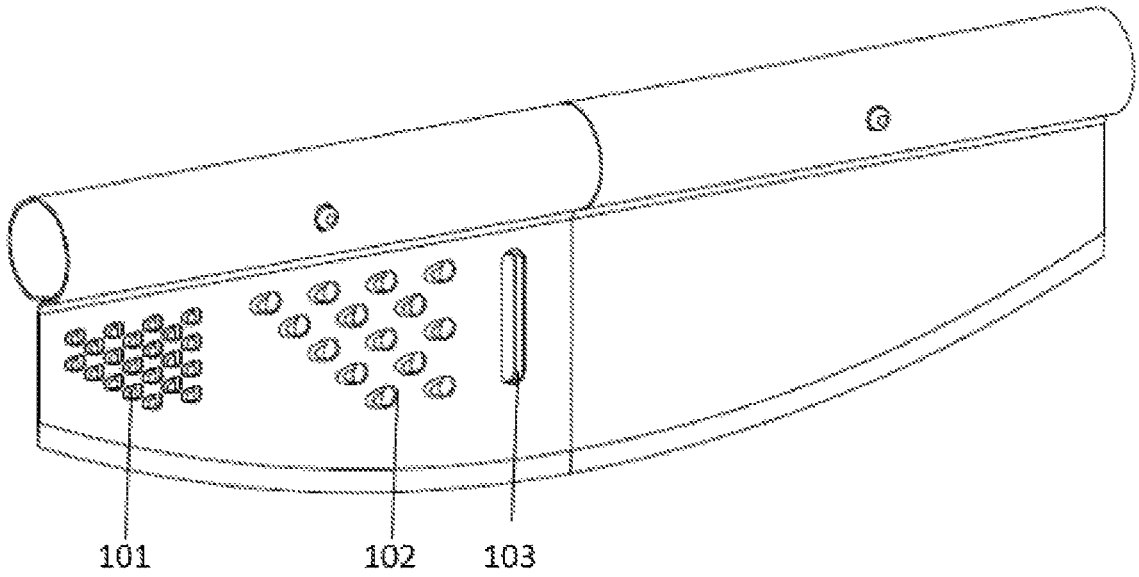
FIG. 32. Is an isometric view of a first embodiment example of a dual knife food cutter with a small grater, a large grater, and a food slicer integrated into the surface of a cutting blade.
Figure 33:
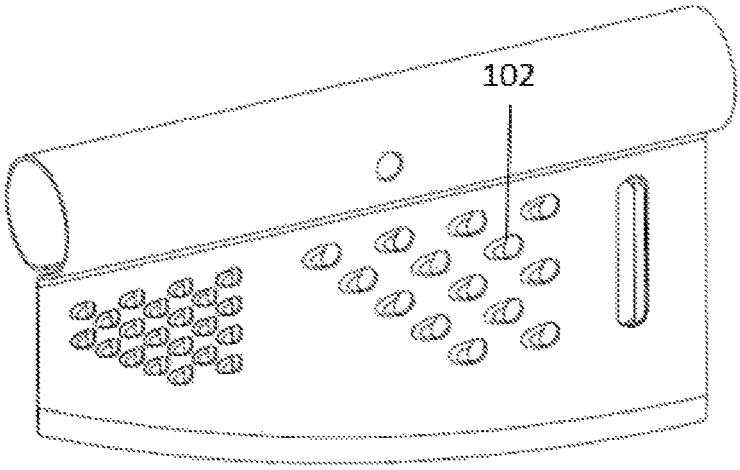
FIG. 33. Is an isometric view of the grater and slicer knife of FIG. 32.
Figure 34:
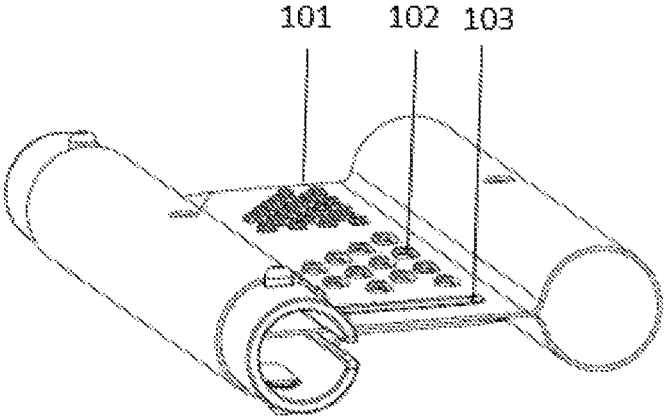
FIG. 34. Is an end angle isometric view of the dual knife food cutter of FIG. 32 in storage mode.

FIGS. 32-34 show a dual knife food cutter with different sized graters and slicers integrated into a blade. In FIG. 32, element 101 shows a small cheese food grater, element 102 shows a large food grater and element 103 shows a food/pepperoni slicer. FIG. 34 shows the blades in a storage configuration. A blade may also integrate a bottle opener or other kitchen tools stamped into the planar portion of the blade or blade handle.

FIG. 36A-D show a magnet feature 131 that can be provided on a blade to assist with storage mode. In this example, one blade will have a hole stamped into the face of the blade, element 132 and the other blade will have a magnet, element 131, so that the magnetic forces between the hole and magnet blades will allow extra hold strength for the blades in storage mode.

Figure 37A:
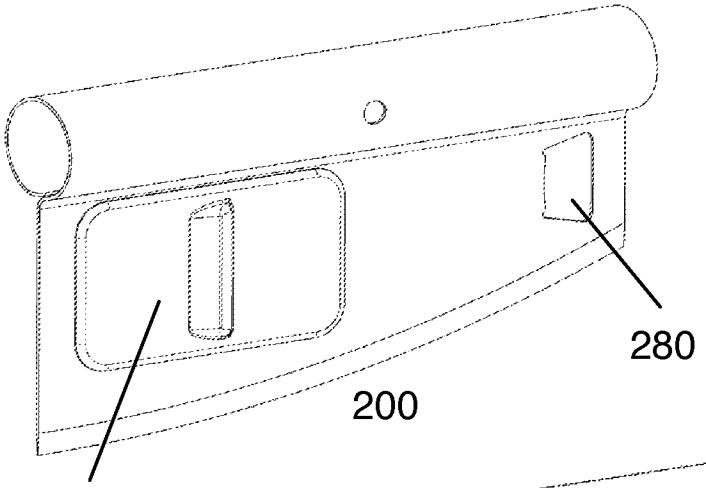
FIG. 37A. Is a front perspective view of a blade with a removable slicer and an opening which serves as a bottle opener.
Figure 37B:
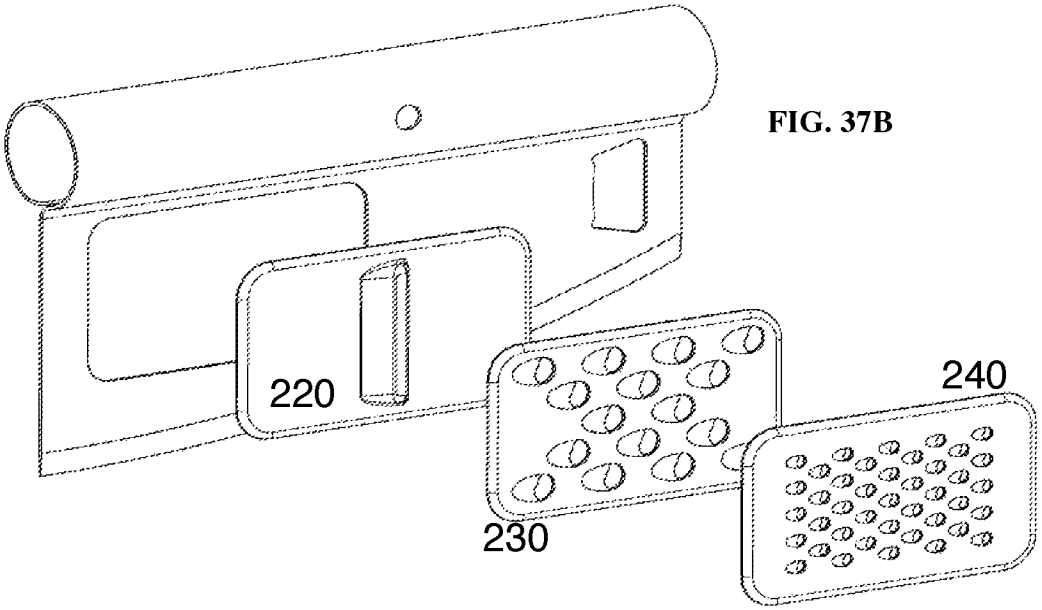
FIG. 37B. Is a front perspective view of several interchangeable removable elements configured to be insertable into an opening on the blade of FIG. 37A.
Figure 37C:
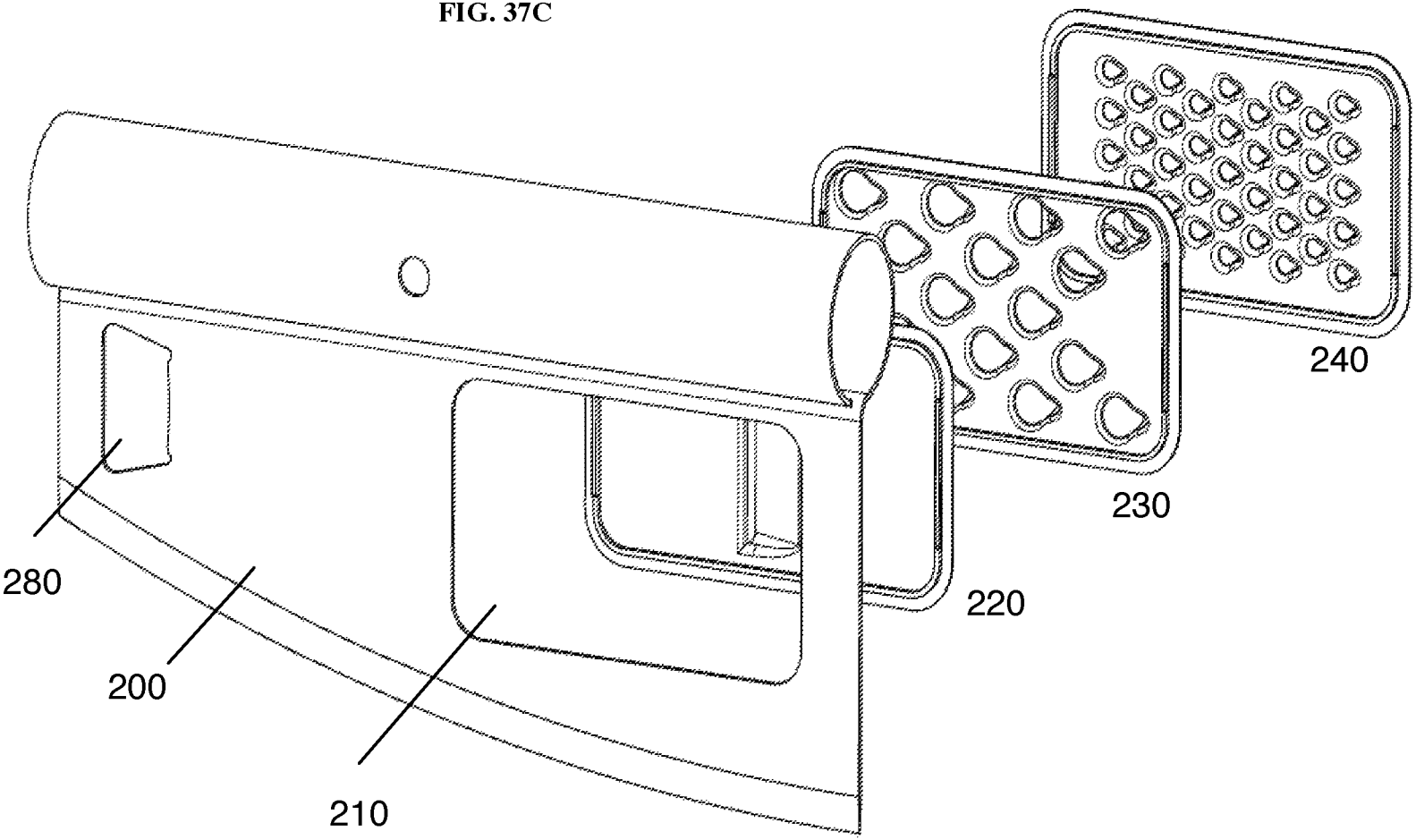
FIG. 37C. Is a rear perspective view of the blade of FIG. 37A showing the integral bottle opener and cutout section.

FIG. 37A is a front perspective view of a blade 200 with a removable slicer 220 and an opening 280 which serves as a bottle opener. FIG. 37B is a front perspective view of several interchangeable removable elements configured to be insertable into an opening on the blade of FIG. 37A. Example removable elements include a slicer 220, a large opening grater 230, and a small opening grater 240. FIG. 37C is a rear perspective view of the blade of FIG. 37A showing the integral bottle opener 280, and cutout section 210. In this example, each of the removable elements has a peripheral ridge that snaps into opening 210. In this embodiment the cutout section 210 in the planar portion of the blade can accept a variety of removable elements. Example removable elements are various types of cheese or vegetable graters, food slicers, mandolin type slicers, food sieves, or various other kitchen tools. A bottle opener may also be provided on a removable element rather than being integral to a blade as shown in FIG. 37A.

Figure 38B:
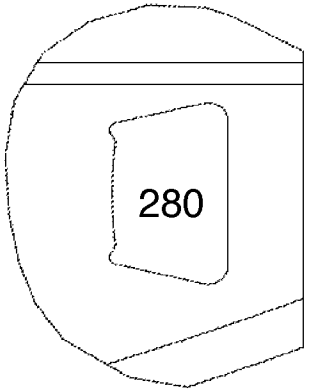
FIG. 38B. Is a detailed view of the bottle opener of FIG. 38A.
Figure 38A:
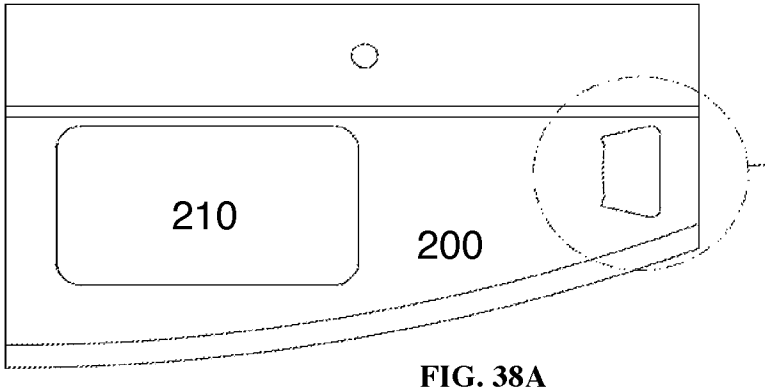
FIG. 38A. Is a front view of the blade of FIG. 37A.

FIG. 38A is a front view of the blade 200 of FIG. 37A. FIG. 38B is a detailed view of the bottle opener 280.

Figure 39B:
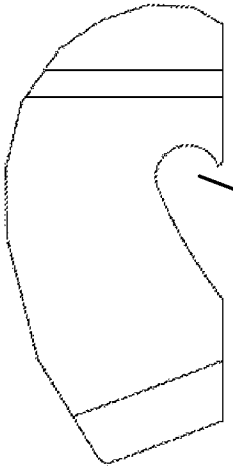
FIG. 39B. Is a detailed view of the bottle opener of FIG. 39A.
Figure 39A:
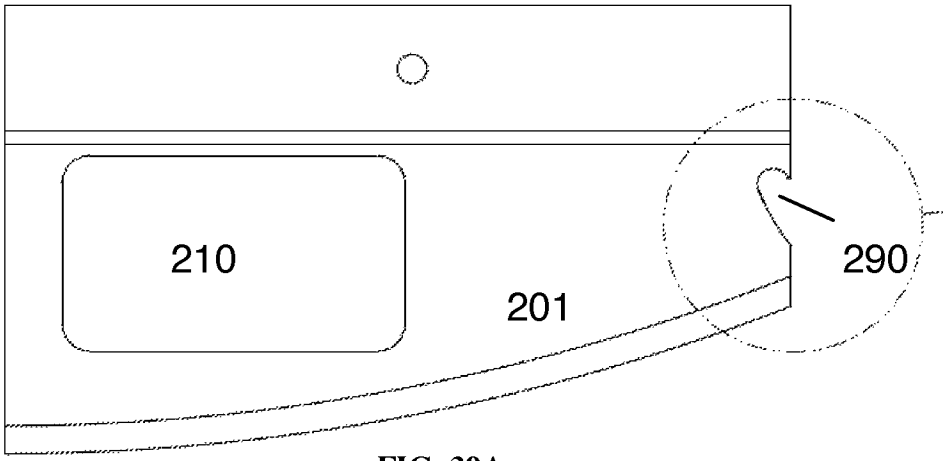
FIG. 39A. Is a front view of a blade with a bottle opener provided in the outside edge of the blade.
Figure 40A:
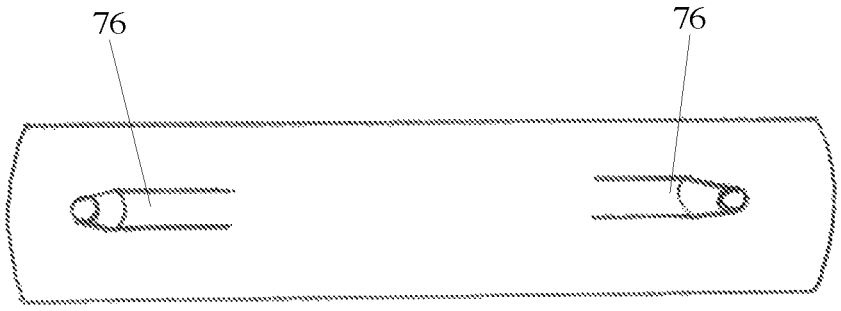
FIG. 40A. Is a front view of an internal connector with integral spring buttons.
Figure 40B:
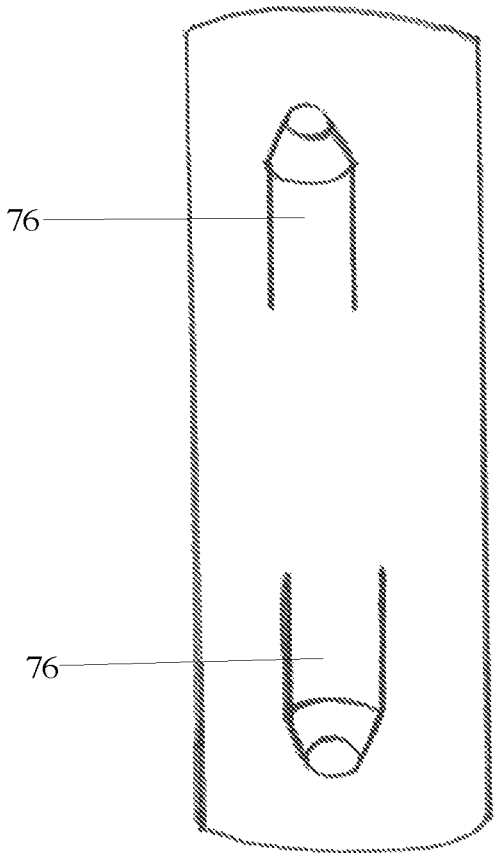
FIG. 40B. Is a front vertical view of an internal connector with integral spring buttons.
Figure 40C:
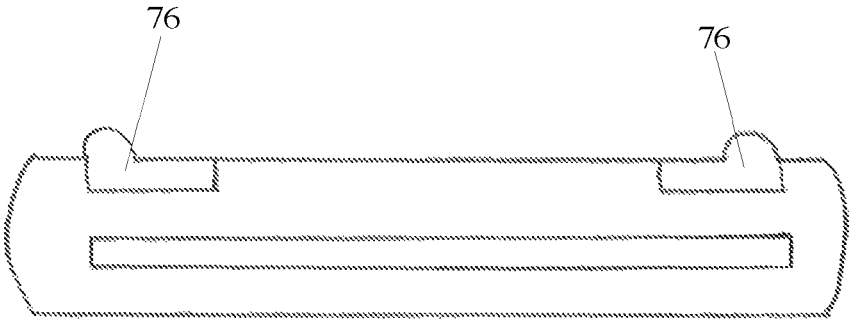
FIG. 40C. Is a side view of an internal connector with integral spring buttons. The connector channel is shown in this view.
Figure 40D:
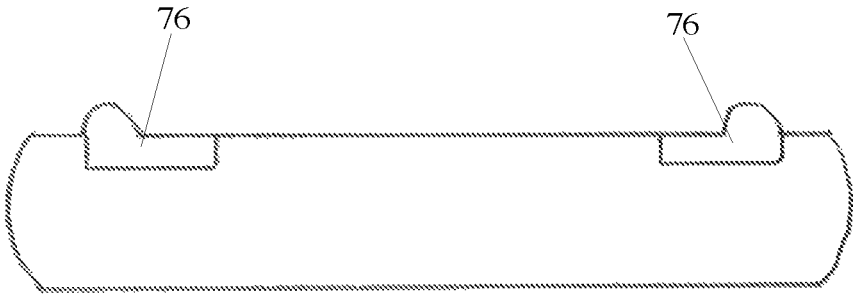
FIG. 40D. Is an alternate side view of an internal connector with integral spring buttons. The connector channel is not shown in this view.

FIG. 39A is a front view of a blade 201 with a bottle opener 290 provided in the outside edge of the blade. FIG. 39B is a detailed view of the bottle opener 290.

Connector Attachment

FIGS. 35A-36D show various connection methods for the blades of the dual knife food cutter. Connection methods can include thread, magnet, snap, foldable hinge, and slide in options. The blades may also be replaced and connected with other interchangeable kitchen accessories beyond the dual knife food cutter blades.

Figure 35A:
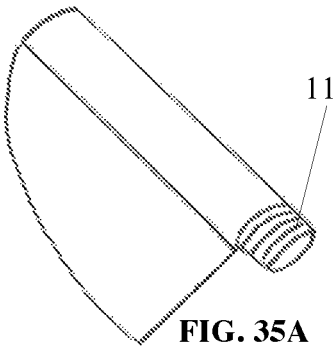
FIG. 35A. Is a front perspective view of a dual knife food cutter with a threaded handle.
Figure 35C:
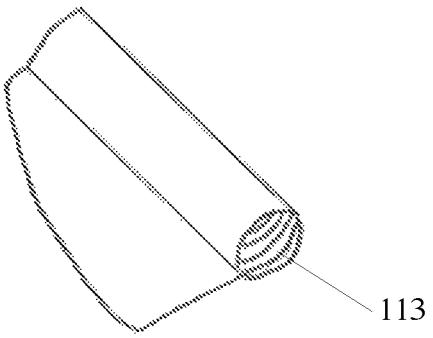
FIG. 35C. Is a front perspective view of a dual knife food cutter with a threaded handle.

FIG. 35C shows a first blade with a female thread connector, element 113. The male thread is located on the second blade on an internal connector component identified as element 114 shown in FIG. 35D. The internal connector, 114 may be concealed in the blade tube to screw the two blades together on the inner edge of the blades to be used as a food cutter or hide for storage mode. Also, the internal connector may be screwed into the outer tube edge of either blade to be used as a cleaver knife.

In another embodiment an internal connector and blade tube assembly can have a snap-in or press fit assembly. There may be slots or grooves added into the blade handle tubing that can key into the internal connector tongue or ribs to allow there to be incremental snap-in locations. For example, the tops of the handle portions are open so the connector may be pushed into the handles and held in place by compression of the handles and alignment features.

Direct Blade Mating

In some embodiments, the first blade and second blade can be connected directly without requiring a separate internal or external connector such as by threaded connection; snap in or press fit; or other mating elements provided on the blades or blade handle portions.

Figure 35B:
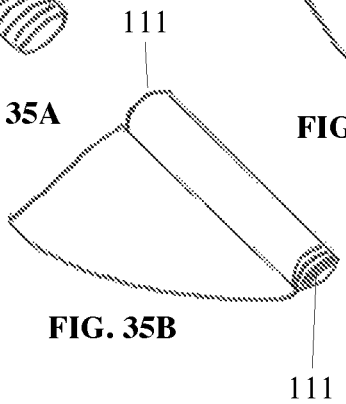
FIG. 35B. Is a front perspective view of a dual knife food cutter with a threaded handle to mate with the handle of FIG. 35A.
Figure 35D:
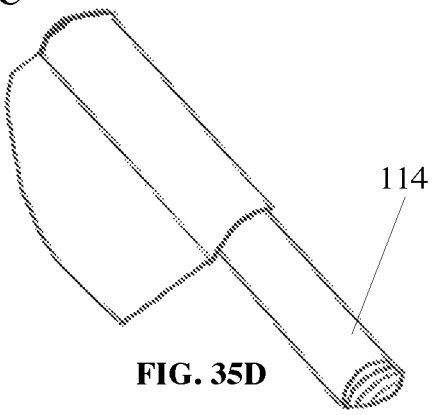
FIG. 35D. Is a front perspective view of a dual knife food cutter with a threaded internal connector handle in cleaver mode.
Figure 36A:
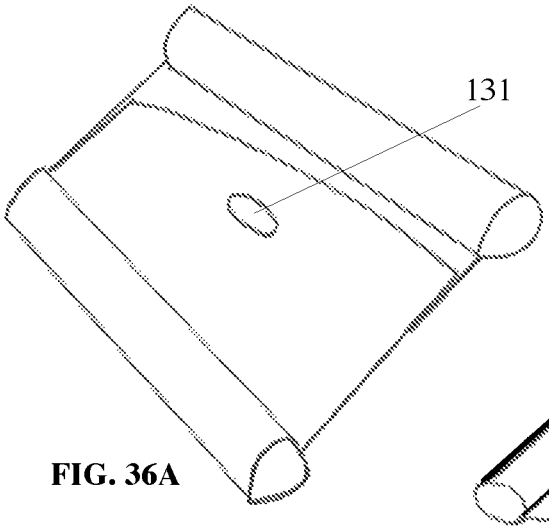
FIG. 36A. Is a perspective view showing an example embodiment of a dual knife food cutter with a magnet or button for added safety and security to retain the blades in storage position.
Figure 36B:
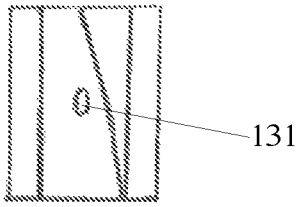
FIG. 36B. Is a front view of the embodiment example shown in FIG. 36A.
Figure 36C:
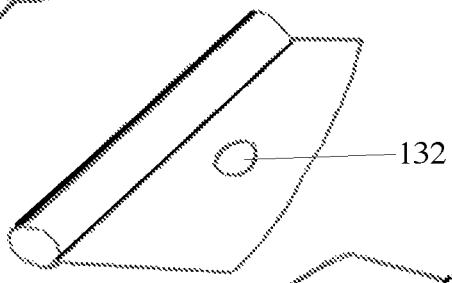
FIG. 36C. Is a side perspective view of a first blade with a hole for the embodiment example shown in FIG. 36A.
Figure 36D:
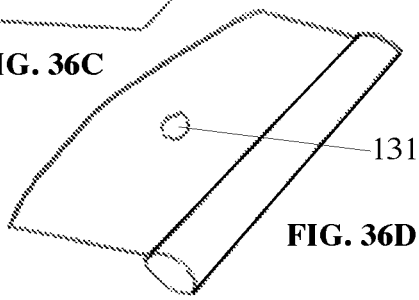
FIG. 36D. Is a side perspective view of a second blade with a magnet for the embodiment example shown in FIG. 36A.

FIG. 35A shows a first blade with a male thread connector, element 112, and a female thread element 111 shown in FIG. 35B located on the second blade. In this example, the threads permit the first blade and second blade handles to be attached to form a single cutting edge.

FIG. 11 shows threaded handles, such as shown in FIGS. 35A and 35B, in a storage configuration.

Figure 12A:
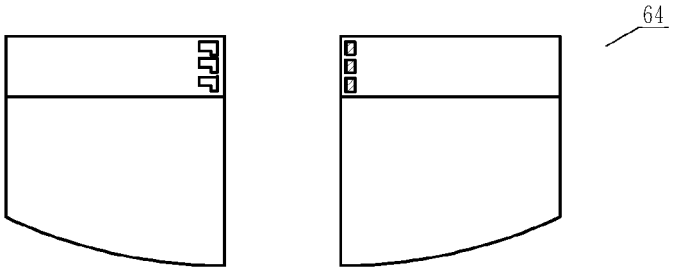
FIG. 12A. Is a front elevation view of another embodiment wherein the first blade and second blade are attached with a bayonet type connection where outwardly projecting L-shaped grooves from a slightly extended handle side of the male blade attaches with the female blade handle side which has at least two inwardly projecting grooves sized and shaped to engage the L-shaped grooves of the male blade.
Figure 12B:
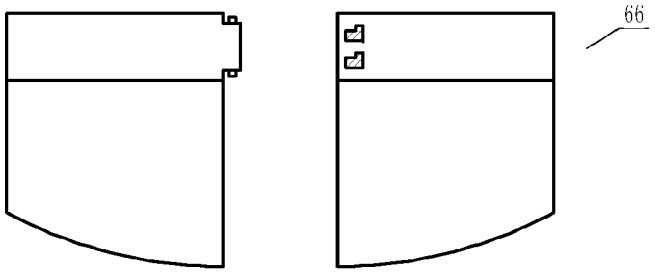
FIG. 12B. Is a front elevation view of another embodiment wherein the first blade and second blade are attached with a bayonet type connection where button type fittings on the male blade attach to L-shaped grooves on the female blade and twist to lock into place.
Figure 13E:
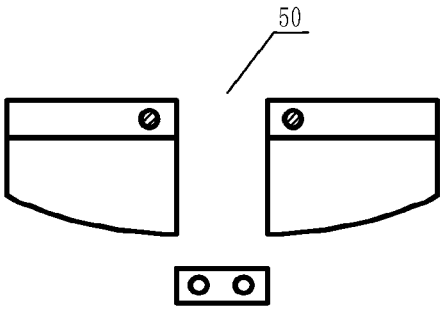
FIG. 13E. Is a front elevation view of another embodiment wherein the first blade and second blade are attached with a male connector that attaches to female holes or rivets in the handle side of the first blade and second blade.
Figure 13F:
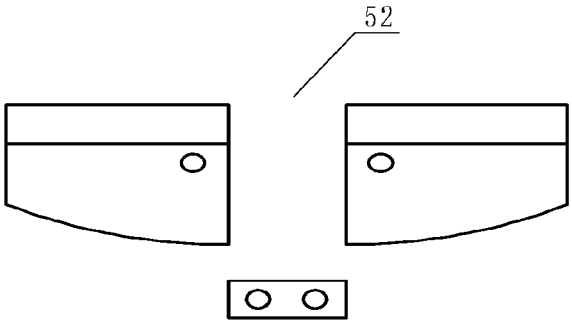
FIG. 13F. Is a front elevation view of another embodiment wherein the first blade and second blade are attached with a male connector that attaches to female holes or rivets in the blades of the first knife and second knife.

In other examples, the handles may be directly attached by other means, such as a bayonet connection such as shown in FIGS. 12A and 12B.

Figure 13G:
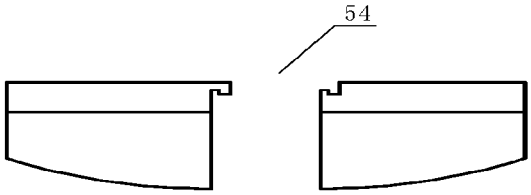
FIG. 13G. Is a front elevation view of another embodiment wherein the first blade and second blade are attached with a male fitting on the end of the handle side of one blade connecting to a female gap on the end of the handle side of the other blade.
Figure 13H:
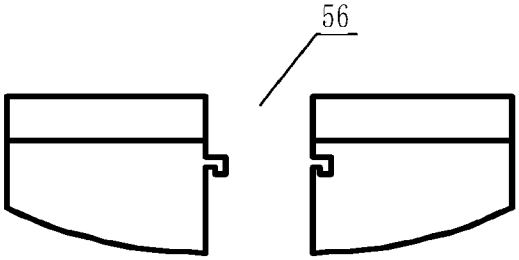
FIG. 13H. Is a front elevation view of another embodiment wherein the knives are attached by a male fitting on the end of the blade attaching to a female gap on the end of the blade of the other knife.
Figure 13I:
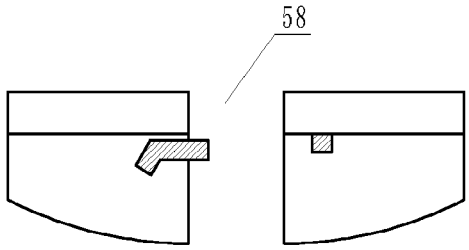
FIG. 13I. Is a front elevation view of another embodiment wherein the first blade and second blade are attached with a connector that swivels out from the blade of one knife and connects to a hole or notch in the blade of the other knife.
Figure 14:
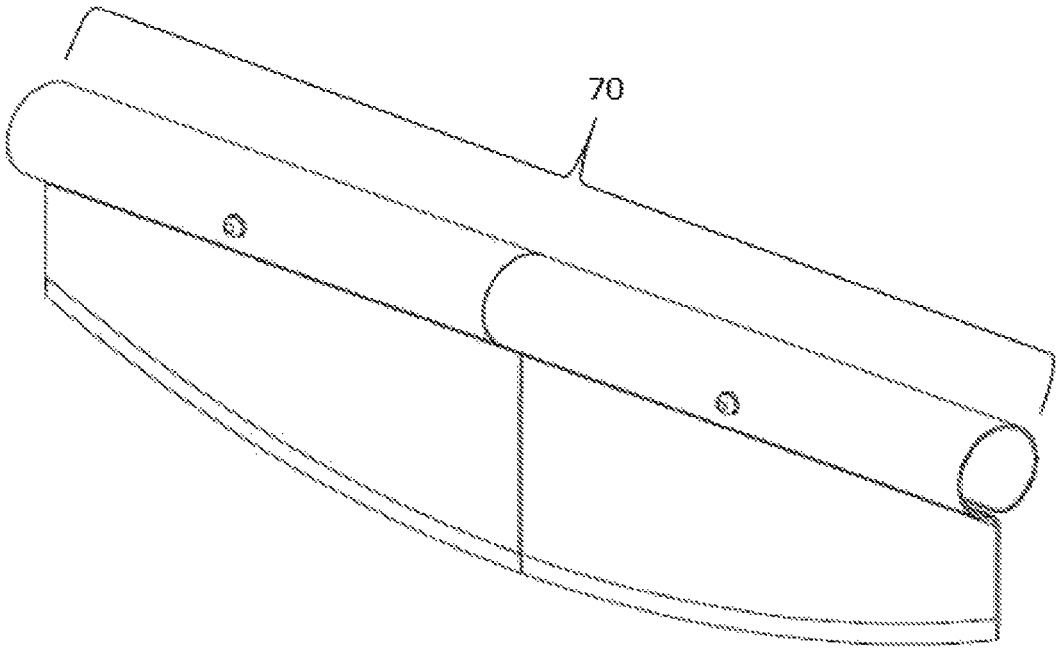
FIG. 14. Is an isometric view of an example of a dual knife food cutter design illustrating a variation of the embodiment in FIG. 1 with a single connecting location for each blade.

Other examples of direct connection of the blade handle portions or the planar portion of the blades are shown in FIGS. 13G-13I.

It will be understood that certain features and sub-combinations are of utility and may be employed without reference to other features and sub-combinations. Since many possible embodiments may be made of the invention without departing from the scope thereof, it is to be understood that all matter herein set forth or shown in the accompanying drawings is to be interpreted as illustrative and not in a limiting sense.

What is claimed is:

1. A dual knife food cutter apparatus configurable into a cutting configuration and a storage configuration, the dual knife food cutter apparatus comprising:

a first blade and a second blade each comprising
- a substantially planar portion comprising a
  - cutting edge,
  - a substantially planar front side, an
  - inside edge,
  - an outside edge, and
  - a substantially planar back side opposite of the front side, and
- the first blade comprising a handle portion opposite to the cutting edge, the handle portion having a first handle length, the handle portion comprising
  - a grip portion with a larger cross section than the distance between the front side and the back side, and
  - an elongated slot sized to allow insertion of the cutting edge of the second blade;

the second blade comprising a handle portion opposite to the cutting edge, the handle portion having a second handle length, the handle portion comprising a grip portion with a larger cross section than the distance between the front side and the back side, and an elongated slot sized to allow insertion of the cutting edge of the first blade;

an external connector configured to be positioned over a portion of the handle portions of each blade wherein in the cutting configuration, the inside edge of the first blade abuts the inside edge of the second blade, the cutting edge of the first blade and the cutting edge of the second blade form a substantially contiguous combined cutting edge; and wherein in the storage configuration, the cutting edge of the first blade is inserted into the slot of the handle portion of the second blade and the cutting edge of the second blade is inserted into the slot of the handle portion of the first blade.

2. The dual knife food cutter apparatus of claim 1 wherein the cutting side of the first blade and the cutting side of the second blade have a convex edge.

3. The dual knife food cutter apparatus of claim 1 wherein the handle portion of the first blade is formed integrally from the same material as the cutting side.

4. The dual knife food cutter apparatus of claim 1 wherein the handle portion of the first blade and the connector are cylindrical shaped tubes.

5. The dual knife food cutter apparatus of claim 1 wherein the first blade further comprises an integral kitchen tool element selected from a group comprising a grater, zester, slicer, sieve, garlic press, bottle opener, or combination thereof.

6. The dual knife food cutter apparatus of claim 1 further comprising a first blade connection feature on the inside edge of the first blade; and a second blade connection feature on the inside edge of the second blade, the second blade connection feature configured to engage the first blade connection feature.

7. The dual knife food cutter apparatus of claim 1 wherein the planar portion of the first blade comprises a cutout sized for insertion of a removable element.

8. The dual knife food cutter apparatus of claim 7 further comprising a removable element selected from a group comprising a grater, zester, slicer, sieve, garlic press, bottle opener, or combination thereof.

* * * * *